US010555576B2

(12) United States Patent
Brust et al.

(10) Patent No.: US 10,555,576 B2
(45) Date of Patent: Feb. 11, 2020

(54) PROTECTIVE HOOD MADE FROM MATERIALS OF VARIABLE STRETCH KNIT AND WOVEN TEXTILES

(71) Applicant: Honeywell International Inc., Morris Plains, NJ (US)

(72) Inventors: Jennifer Brust, Bellbrook, OH (US); Jon Allen, Morris Plains, NJ (US); Alan W. Schierenbeck, Dayton, OH (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 331 days.

(21) Appl. No.: 14/986,265

(22) Filed: Dec. 31, 2015

(65) Prior Publication Data

US 2017/0188651 A1 Jul. 6, 2017

(51) Int. Cl.

| | |
|---|---|
| ***A42B 3/10*** | (2006.01) |
| ***A62B 17/04*** | (2006.01) |
| ***A42B 1/04*** | (2006.01) |

(52) U.S. Cl.

CPC ..... *A42B 3/105* (2013.01); *A42B 1/045* (2013.01); *A62B 17/04* (2013.01)

(58) Field of Classification Search

CPC ..... A42B 3/105; A42B 1/045; A62B 17/04
USPC ..... 2/202, 195.1, 195.2, 181
See application file for complete search history.

(56) References Cited

U.S. PATENT DOCUMENTS

| | | | | |
|---|---|---|---|---|
| 2,560,598 A | | 7/1951 | Rinis | |
| 2,679,647 A | | 6/1954 | Gossner | |
| 4,972,520 A | | 11/1990 | Grilliot et al. | |
| 5,090,054 A | | 2/1992 | Grilliot et al. | |
| 5,109,549 A | * | 5/1992 | Mattinson | A41D 31/08 2/202 |
| 5,628,065 A | * | 5/1997 | Austin | A42B 1/048 2/202 |
| 5,873,132 A | | 2/1999 | Grilliot et al. | |
| 6,006,360 A | | 12/1999 | Reed | |
| 6,038,700 A | * | 3/2000 | Aldridge | A41D 13/00 2/81 |
| 6,654,963 B2 | | 12/2003 | Fayle et al. | |
| 6,662,375 B2 | | 12/2003 | Lewis | |
| 7,380,286 B1 | | 6/2008 | Bryant, Sr. | |

(Continued)

FOREIGN PATENT DOCUMENTS

| | | |
|---|---|---|
| DE | 10308710 A1 | 9/2004 |
| EP | 0 673 609 A1 | 3/1995 |

(Continued)

OTHER PUBLICATIONS

International Preliminary Report on Patentability and Written Opinion dated Jul. 12, 2018.

(Continued)

*Primary Examiner* — Alissa J Tompkins
*Assistant Examiner* — Brieanna Szafran
(74) *Attorney, Agent, or Firm* — Alston & Bird LLP

(57) ABSTRACT

A protective hood (10) is provided for use by a firefighter or other emergency worker, and includes a crown portion (12), a head portion (14), a face opening (16) defined by a peripheral edge (18), and front and rear drapes (20,22). At least some of the parts (12,14,18,20,22) are formed from a knit material and at least other of the parts (12,13,18,20,22) are formed from at least one layer of woven material.

20 Claims, 2 Drawing Sheets

(56) References Cited

U.S. PATENT DOCUMENTS

| | | | | |
|---|---|---|---|---|
| 7,594,281 | B1 * | 9/2009 | Stinson | A41D 13/0007 2/310 |
| 8,225,428 | B2 | 7/2012 | Grilliot et al. | |
| 8,707,472 | B2 * | 4/2014 | Stachler | A62B 17/04 128/201.24 |
| 9,155,922 | B2 | 10/2015 | Samaniego | |
| 2003/0033657 | A1 * | 2/2003 | Austin | A42B 1/046 2/81 |
| 2005/0193472 | A1 * | 9/2005 | Courtney | A62B 17/04 2/202 |
| 2008/0196145 | A1 * | 8/2008 | Grilliot | A42B 1/046 2/202 |
| 2009/0025112 | A1 * | 1/2009 | Corsini | A42B 1/046 2/7 |
| 2010/0031422 | A1 | 2/2010 | Grilliot et al. | |
| 2010/0064417 | A1 | 3/2010 | Fruge | |
| 2011/0094020 | A1 * | 4/2011 | Brookman | A62B 17/003 2/457 |
| 2012/0174296 | A1 | 7/2012 | Martin | |

FOREIGN PATENT DOCUMENTS

| | | |
|---|---|---|
| GB | 181617 | 6/1922 |
| JP | 8-232109 | 9/1996 |

OTHER PUBLICATIONS

Intention to Grant for European Application No. 16829174.8, dated Nov. 29, 2019, 5 pages.

* cited by examiner

PROTECTIVE HOOD MADE FROM MATERIALS OF VARIABLE STRETCH KNIT AND WOVEN TEXTILES

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This disclosure relates to protective hoods, and in particular, to protective hoods such as worn by a firefighter or other emergency responder.

BACKGROUND

Protective hoods, such as those used by firefighters are exemplified in U.S. Pat. Nos. 4,972,520; 5,090,054; 5,873,132; 6,662,375 and 8,225,428, the disclosures of which are incorporated herein by reference, and are also available commercially from Honeywell International Inc. of Morristown, N.J. Protective hoods are also used by others such as race car drivers, rescue workers and other emergency personnel.

Protective hoods, as standalone items or when connected to a garment, as utilized in military, industrial, firefighting, recreational, or cold weather activities, (and other applications) have previously been constructed in two competing yet totally different types: hoods manufactured and constructed using woven textiles; and hoods manufactured and constructed of knit textiles. Each type has its own particular strengths and weaknesses wherein:

1. For both types of hoods the effectiveness and fit/function is impacted when utilized in combination with other head mounted gear such as one or more of the following (but not limited to): cold weather masks; partial face respirators; full face air masks; bump caps/helmets; prescription eyewear; protective glasses; protective goggles; night vision or infrared equipment; hearing protection muffs.

2. Due to the nature of knit textiles, hoods made from knit(s) have a greater ability to stretch and comfortably fit over the head, and/or the head with ancillary head worn gear, such as but not limited to respirators, air masks and eye/face protection. The down sides are that: the stretched knit material opens up the spaces between the yarns and allows a greater quantity and size of particulate matter, as well as air or liquid, to pass through as compared to the un-stretched knit material; eventually the rebound memory of the knit material deteriorates and the fit, both with and without ancillary head worn gear, becomes loose to the point of providing unsatisfactory performance; and a hood made of knit material provides a higher level of insulation value when the knit material is unstretched than does the same hood when the knit material is stretched, which is particularly an issue when the design is to provide protection from low or high temperature extremes.

3. Hoods made from woven textiles are more challenging when it comes to fitting to the head, both with and without ancillary head gear.

4. The inherent properties of insulation and particulate/air/liquid penetration of the woven textiles, coated/laminated and uncoated, for the most part remain nearly constant since the spaces between the yarns remain nearly the same size regardless of whether it is worn with or without ancillary head gear.

SUMMARY

In accordance with one feature of this disclosure, a protective hood is provided for use by a firefighter or other emergency worker. The hood includes a crown portion to cover the top of a wearer's head, a head portion that extends downward from the crown portion to cover at least the sides and back of the head, and a face opening in the head portion for at least the eyes of a wearer. The face opening is defined by a peripheral edge that surrounds the face opening, wherein at least one of the crown portion and all or part of the peripheral edge is formed from at least one layer of knit material, and all or part of the head portion comprises at least one layer of a woven textile, coated/laminated or uncoated.

As one feature, the crown portion is formed from at least one layer of knit material.

In one feature, all or part of the peripheral edge is formed from at least one layer of knit material.

According to one feature, the peripheral edge comprises at least one layer of a woven textile.

As one feature, the peripheral edge is formed from at least one layer of knit material. In a further feature, the crown portion comprises at least one layer of a woven textile.

According to one feature, the hood further includes a front drape and a rear drape that extend downward from the head portion to cover at least a portion of the front and back, respectively, of the neck and shoulders of a wearer. At least one of the crown portion, all or part of the peripheral edge, the front drape, and the rear drape is formed from at least one layer of knit material.

As one feature, the crown portion is formed from at least one layer of knit material. In a further feature, all or part of the peripheral edge is formed from at least one layer of knit material. According to a further feature, the front and rear drapes include at least one layer of a woven textile. As one feature the peripheral edge comprises at least one layer of a woven textile.

In one feature, at least one of the front and rear drapes are formed from at least one layer of knit material. According to one feature, all or part of the peripheral edge is formed from at least one layer of knit material. As a different feature, the peripheral edge comprises at least one layer of a woven textile.

In one feature, all or part of the peripheral edge is formed from at least one layer of knit material. According to one further feature, the crown portion comprises at least one layer of a woven textile. As one further feature, at least one of the front and back drapes comprise at least one layer of a woven textile.

In one feature, at least one of the front and back drapes is formed from at least one layer of knit material. According to one further feature, the crown portion includes at least one layer of a woven textile. As one further feature, the peripheral edge comprises at least one layer of a woven material.

Other features and advantages will become apparent from a review of the entire specification, including the appended claims and drawings.

DETAILED DESCRIPTION

Figure 1:
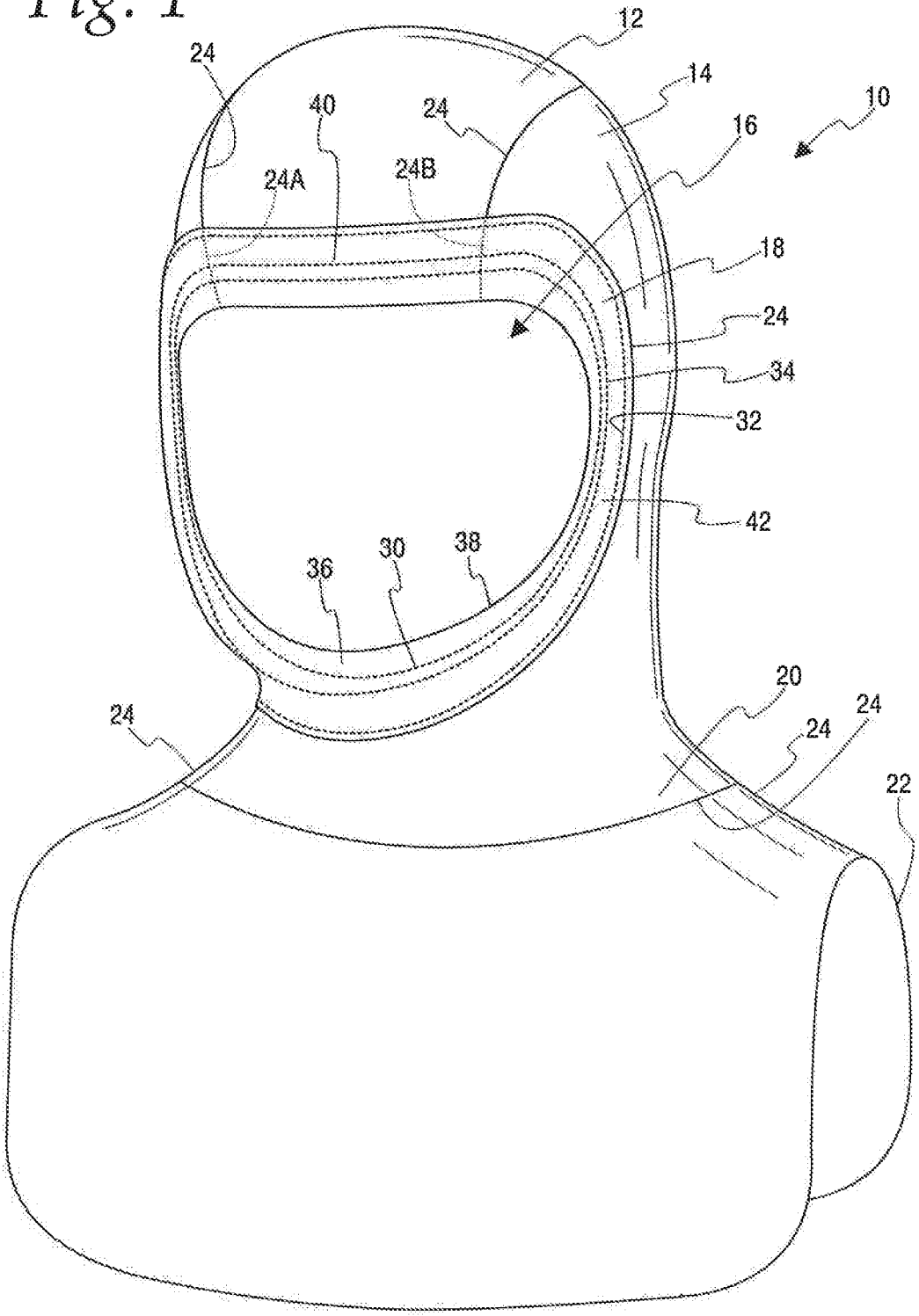
FIG. 1 is a front perspective view of a protective hood according to this disclosure in a donned position on a wearer (not shown)
Figure 2:
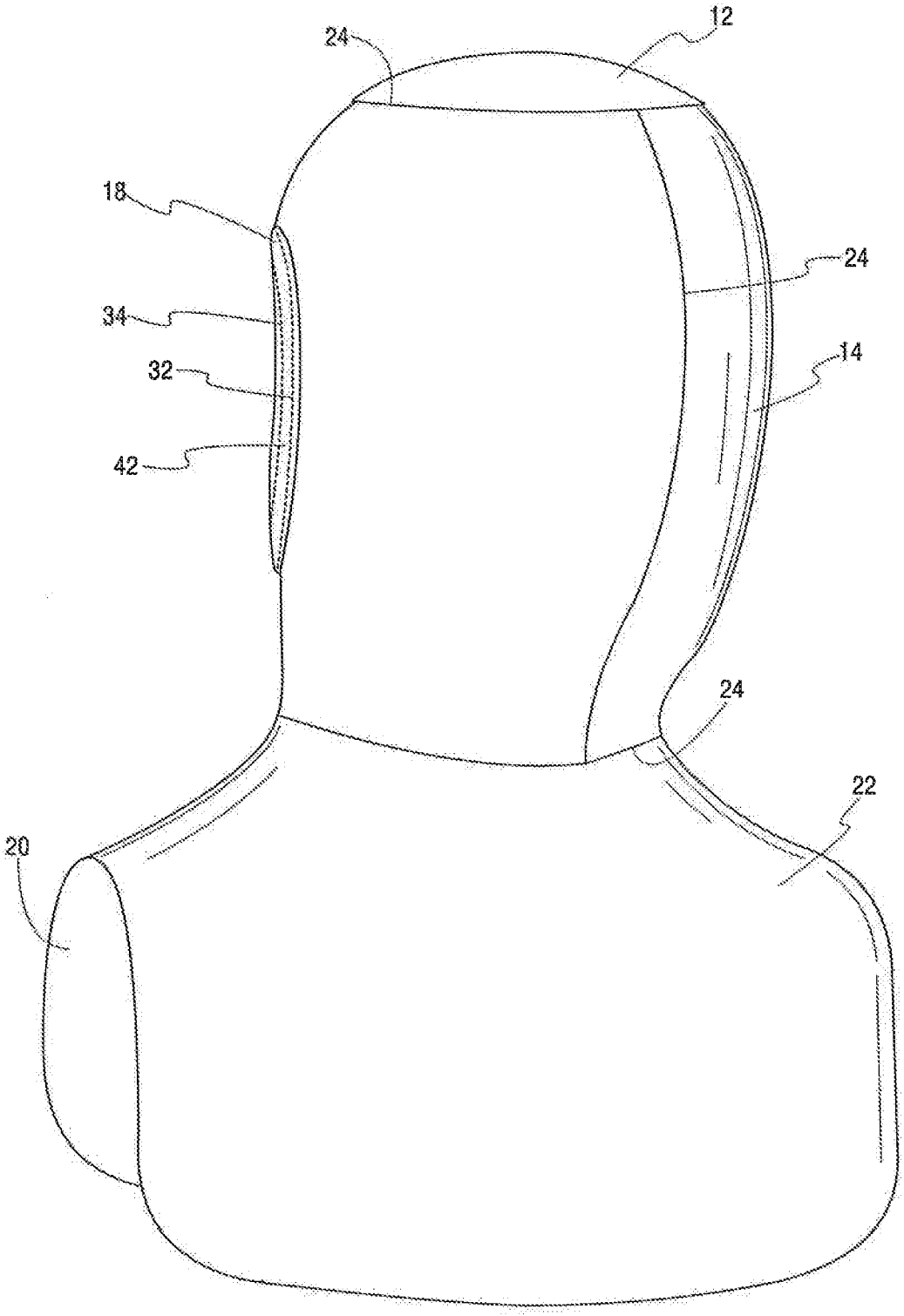
FIG. 2 is a rear perspective view of the hood of FIG. 1.

With reference to FIG. 1, a protective hood 10 is provided for use by firefighters, emergency responders, and others who need protection from a hazardous environment that may include extreme heat, fire, dangerous chemicals, water, biohazards, and the like. The protective hood 10 uses both woven and knit textile materials to form a single hood, with each of the materials being utilized in the hood 10 at locations where their respective positive qualities are most needed and desirable, based upon the particular desired use of the protective hood 10. In this regard, for example, if the hood is intended to be worn with a face mask/face piece, it may desirable to utilize woven materials (coated/laminated or uncoated) in certain locations that would not be desirable in hoods that are not intended to be worn with a face mask or face piece. As another example, some protective garments worn in combination with the hood may be best suited for a woven material to be utilized in the drape, while other garments may be bested suited for a knit material to be utilized in the drape.

The hood 10 includes a crown portion 12 to cover the top of a wearer's head, and a lower or head portion 14 extending downward from the crown portion 12 to cover the back, sides and front of the wearer's head and, in the illustrated embodiment, part of the wearer's neck, with a face opening 16 for at least the eyes of a wearer. The face opening 16 is defined (surrounded) by a peripheral seam or edge 18 that surrounds the face opening 16. The hood 10 further includes a front drape 20 and a rear drape 22 that extend downward from the head portion 14 to cover at least a portion of the front and back, respectively, of the neck and shoulders of the wearer. The crown portion 12, head portion 14, peripheral edge 18, front drape 20 and rear drape 22 will be permanently connected to each other by seams 24 using a suitable seam connection, such as by sewing a stitched connection (as shown by the stitch lines at 30, 32 and 34 in FIG. 1) or by bonding, to provide two suitable examples.

As seen in FIG. 1, the crown portion 12 covers a minimum of 10% of wearer's head in the illustrated embodiment. In terms of human anatomy, the crown portion 12 of the typical hood 10 will extend from at or adjacent the brow ridge, over the frontal skull bone, over the coronal suture, and to the parietal bone, stopping short of or extending no further than the lambdoid suture of a wearer's head. Laterally, the crown portion 12 of the typical hood 10 will stop short of the sphenoid and temporal bones on each side of a wearer's head.

In the illustrated embodiment, at least one of the crown portion 12, the peripheral edge 18, the front drape 20, and the rear drape 22 is formed from at least one layer of knit material, and all or part of the head portion 14 includes, or is formed from, at least one layer of a woven material. In one form of this embodiment, each of the crown portion 12, the peripheral edge 18, the front drape 20 and the rear drape 22 will include, or is formed from, at least one layer of woven textile if the respective part 12, 18, 20 or 22 is not formed from at least one layer of knit material. In this regard, in most embodiments the at least one layer of woven textile will extend over the entirety of any of the crown portion 12, the front drape 20, and the rear drape 22 that includes the at least one layer of woven material. Similarly, in most embodiments the at least one layer of knit material will extend over the entirety of any of the crown portions 12, the front drape 20, and the rear drape 22 that includes the at least one layer of knit material.

In one embodiment of the hood 10 that will be highly desired in applications where a wearer must also don a face mask and a helmet, the peripheral edge 18 is formed from a combination of one or more layers of knit material and one or more layers of woven material. As best seen in FIG. 1, in this embodiment, the peripheral edge 18 includes an innermost band 36 located between the line of stitching 30 and the inner most lip or edge 38 (often referred to as the "leading edge") of the peripheral edge 18 and encircling the face opening 16. This innermost band 36 is formed from one or more layers of knit material, with an elastic member (not illustrated) encircling the face opening 16 and encased within the layers of knit material to allow the face opening 16 to be adapted to the particular configuration and size of each wearer's face. The peripheral edge 18 of this embodiment also includes a brow band 40 at the top of the face opening 16 that extends space longitudinally between stitch lines 30 and 34 and laterally between seam lines 24A and 24B which extend downward from the seams 24 to the face opening 16. The brow band 40 is also formed from one or more layers of knit material and also aids in allowing the face opening 16 to be adapted to the particular configuration of each wearer's face. Last, the peripheral edge 18 of this embodiment includes a woven band 42 that extends over the remainder of the peripheral edge 18 between the stitch lines 30 and 34 and between the stitch lines 24A and 24B to define the sides and bottom of the peripheral edge 18. The woven band at 42 is formed from one or more layers of woven material. This allows for woven material to extend below and from the seal of the facemask that is exposed below the helmet of a wearer, while the brow band 40 allows the sweatband of a helmet to engage a knit material at the face opening 16.

In one embodiment, the crown portion 12 is formed from a knit material and the remaining parts 14, 18, 20 and 22 of the hood 10 include, or are formed from at least one layer of woven material.

In another embodiment of the hood 10, the crown portion 12 and peripheral edge 18 are formed from knit material, and the head portion 14, or at least part of the head portion 14, and the front and rear drapes 20 and 22 include, or are formed from, at least one layer of woven material.

In another embodiment of the hood 10, the crown portion 12 and at least one of the front and rear drapes 20 and 22 are formed from a knit material and the remaining parts of the hood 10 include, or are formed from, at least one layer of woven textiles.

In another embodiment of the hood 10, the crown portion 12, the peripheral edge 18 and at least one of the front and rear drapes 20 and 22 are formed from a knit material, and the remaining parts of the hood 10 include, or are formed from, at least one layer of woven textiles.

In yet another embodiment of the hood 10, the crown portion 12, the peripheral edge 18, the head portion 14, or at least part of the head portion 14, all include, or are formed from, at least one layer of woven textile, and at least one of the front and rear drapes 20 and 22 is formed from a knit material.

In another embodiment of the protective hood 10, the crown portion 12, the head portion 14, or at least part of the head portion 14, include, or are formed from, at least one layer of woven textile, and the peripheral edge 18 and at least one of the front and rear drapes 20 and 22 are formed from a knit material.

The knit materials and the woven materials can be of any suitable type for a protective gear, many of which are known. In many applications it will be desirable for the materials to be fire resistant and/or thermal insulative to protect the wearer.

As disclosed herein, the protective hood 10 combines both woven and knit textile materials into a single hood 10 wherein the respective positive qualities of the knit material and the woven material are located in those areas of the hood 10 where they are most needed and desirable, and thereby provide advantages over protective hoods that are either all woven or all knit.

It should be understood that the illustrated embodiment shows only one possible construction for the protective hood 10 as disclosed herein and that this disclosure anticipates modifications to that particular embodiment. For example, the size and extent of each of the crown portion 12, the head portion 14, the face opening 16, the peripheral edge 18, the front drape 20, and the rear drape 22 may vary depending upon the requirements of each particular application and the size and shape intended for the particular wearer's head. By way of further example, the location and shape of each of the seams 24, 30, 32 and 34 may vary, again depending upon the particular requirements of each application. As yet a further example, the hood 10 may be produced without one of the front drape 20 and the rear drape 22, or without both the front drape 20 and rear drape 22. In another example, the peripheral edge 18 may be produced without an elastic member, and/or entirely out of knit material and/or entirely out of woven material, again depending upon the requirements of each particular application.

The invention claimed is:

1. A protective hood for use by a firefighter or other emergency worker, the hood comprising:

a crown portion to cover the top of a wearer's head;

a head portion that extends downward from the crown portion to cover at least a first side, a second side, and a back of the wearer's head, the head portion comprising one or more layers of the first woven material; and a face opening in the head portion corresponding with the wearer's eyes, the face opening defined by a peripheral edge that surrounds the face opening, the peripheral edge defined by a first band formed from one or more layers of a first knit material disposed about and elastic member, the first band coupled to a second band formed from one or more layers of a second elastic member, and a third band coupled to the second band and the head portion, the third band formed from one or more layers of a second woven material, each of the first woven material, the first material, the second knit material, and the second woven material being fire resistant.

2. The protective hood of claim 1, wherein the crown portion is formed from at least one layer of knit material.

3. The protective hood of claim 1, wherein the crown portion comprises one or more layers of a third woven material.

4. The protective hood of claim 1 further comprising a front drape and a rear drape, both the front drape and the rear drape coupled to the extending in a downward direction from the head portion to cover at least a portion of the neck and shoulders of the wearer.

5. The protective hood of claim 4, wherein the crown portion is formed from at least one layer of knit material.

6. The protective hood of claim 4, wherein at least one of the front drape and the rear drape include one or more layers of a third woven material.

7. The protective hood of claim 4 wherein at least one of the front drape and the rear drape is formed from one or more layers of a knit material.

8. A protective hood for the use by a firefighter or other emergency worker, the hood comprising:

a crown portion to cover a top of a wearer's head;

a head portion that extends downward from the crown portion to cover at least a first side, a second side, and a back of the wearer's head, the head portion comprising one or more layers of a woven material;

an aperture defined in a front of the head portion, the aperture suitable to accommodate a portion of a wearer's face;

a first band formed from one or more layers of a first knit material, the first band coupled circumferentially along a first edge to the head portion within the aperture;

a second band comprising one or more layers of a second knit material, the second band coupled circumferentially to the band along a second edge of the first band, the second band disposed about an elastic member.

9. The protective hood of claim 8, wherein the crown portion is formed from one or more layers of a third knit material.

10. The protective hood of claim 8, wherein the woven material is a first woven material, the crown portion being formed from one or more layers of a second woven material.

11. The protective hood of claim 8, further comprising a front drape and a rear drape, both of the front drape and the rear drape coupled to and extending in a downward direction from the head portion to cover at least a portion of a neck and shoulders of the wearer.

12. The protective hood of claim 11, wherein the front drape and the rear drape are formed from one or more layers of a second woven material.

13. The protective hood of claim 11, wherein at least one of the front drape and the rear drape are formed from one or more layers of a third knit material.

14. The protective hood of claim 8, wherein at least one of the woven material, the first knit material, and the second knit material is fire resistant or thermally insulating.

15. A protective hood for use by a firefighter or other emergency worker, the hood comprising:

a crown portion to cover a top of a wearer's head;

a head portion that extends downward from the crown portion to cover at least sides and back of the wearer's head, the head portion comprising one or more layers of a first woven material;

a face opening defined by an aperture in a front of the head portion, the face opening defined at least in part by a first edge of an innermost band encircling the face opening, the innermost band comprising a one or more layers of a first knit material disposed about an elastic member;

a brow band coupled along a first edge to a second edge of the innermost band, the brow band comprising one or more layers of a second knit material;

a woven band coupled along a first edge to a second edge of the brow band, the brow band coupled along a second edge to the head portion, the woven band comprising one or more layers of a second woven material; and a front drape and a rear drape, both of the front drape and the rear drape coupled to and extending in a downward direction from the head portion to cover at least a portion of a neck and shoulders of the wearer.

16. The protective hood of claim 15, wherein the crown portion is formed one or more layers of a third knit material.

17. The protective hood of claim 15, wherein the crown portion is formed from one or more layers of a third woven material.

18. The protective hood of claim 15, wherein the front drape and the rear drape is formed from one or more layers of a woven textile.

19. The protective hood of claim 15, wherein at least one of the front drape and the rear drape is formed from one or more layers of a third knit material.

20. The protective hood of claim 15, wherein at least one of the first woven material, the second woven material, the first knit material, and the second knit material is fire resistant or thermally insulating.

* * * * *